US010465497B2

(12) United States Patent
Yin et al.

(10) Patent No.: US 10,465,497 B2
(45) Date of Patent: Nov. 5, 2019

(54) NEAR-BIT MEASUREMENT WHILE DRILLING SYSTEM

(71) Applicant: Orient Energy & Technologies Co., Ltd., Langfang, Hebei (CN)

(72) Inventors: Yongqing Yin, Hebei (CN); Shaoqiu Shi, Hebei (CN); Bosheng Yang, Hebei (CN); Xiyuan Wang, Hebei (CN); Jin Hu, Hebei (CN); Lizhong Lu, Hebei (CN); Guoqing Qu, Hebei (CN)

(73) Assignee: ORIENT ENERGY & TECHNOLOGIES CO., LTD., Langfang, Hebei (CN)

( * ) Notice: Subject to any disclaimer, the term of this patent is extended or adjusted under 35 U.S.C. 154(b) by 64 days.

(21) Appl. No.: 15/748,120

(22) PCT Filed: Sep. 8, 2016

(86) PCT No.: PCT/CN2016/098445
§ 371 (c)(1),
(2) Date: Jan. 26, 2018

(87) PCT Pub. No.: WO2018/018712
PCT Pub. Date: Feb. 1, 2018

(65) Prior Publication Data

US 2018/0355710 A1 Dec. 13, 2018

(30) Foreign Application Priority Data

Jul. 26, 2016 (CN) ..... 2016 1 0596074

(51) Int. Cl.
*E21B 47/024* (2006.01)
*E21B 7/06* (2006.01)
(Continued)

(52) U.S. Cl.
CPC ..... *E21B 47/024* (2013.01); *E21B 4/00* (2013.01); *E21B 7/04* (2013.01); *E21B 7/068* (2013.01);
(Continued)

(58) Field of Classification Search
CPC ..... E21B 47/024; E21B 47/00; E21B 17/20; E21B 17/03; E21B 17/028; E21B 7/068;
(Continued)

(56) References Cited

U.S. PATENT DOCUMENTS 5,448,227 A * 9/1995 Orban ..... E21B 7/068 340/854.4
5,725,061 A 3/1998 Van Steenwyk et al.
(Continued)

FOREIGN PATENT DOCUMENTS

CN 101070757 A 11/2007
CN 101881155 A 11/2010
(Continued)

*Primary Examiner* — David J Bagnell
*Assistant Examiner* — Jonathan Malikasim
(74) *Attorney, Agent, or Firm* — Novick, Kim & Lee, PLLC; Allen Xue

(57) ABSTRACT

A system of near-bit measurement while drilling system includes motor system, measurement transmission system, wireless receiving system and non-magnetic short sub. The measurement transmission system is set inside the motor system, and the transmitting device from the measurement transmission system and the receiving device from the wireless receiving system are set inside the non-magnetic cavity. In the process of drilling via drill bit, the azimuth gamma and the well deviation parameters on the formation where the drill bit is located is able to be measured in real time more accurately and then will make real-time wireless transmission toward the wireless receiving system. Compared with conventional measurement while drilling work, the measurement location of the near-bit measurement while
(Continued)

Figure 1:
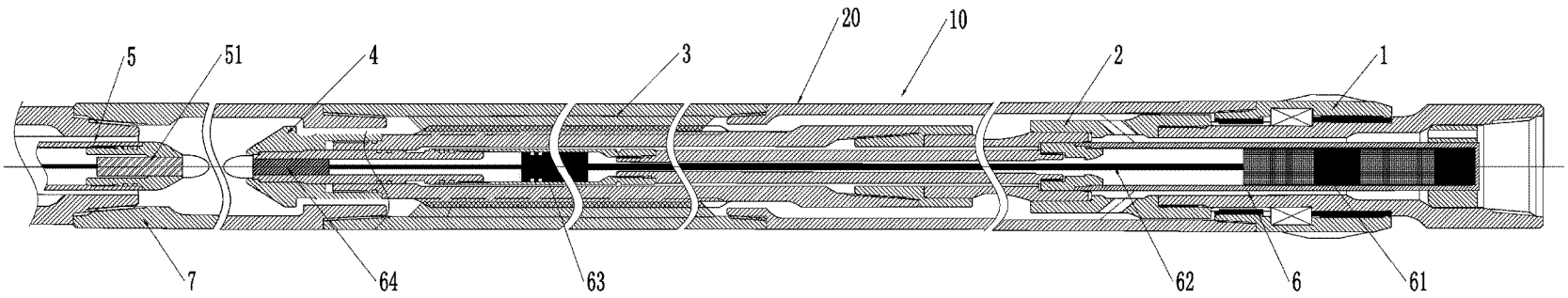

drilling system is nearer to the drill bit with non-hysteretic description of well trajectory and formation gamma measurement so as to enhance the drilling-encounter ratio significantly.

11 Claims, 5 Drawing Sheets

(51) Int. Cl.

| | |
|---|---|
| ***E21B 17/02*** | (2006.01) |
| ***E21B 17/03*** | (2006.01) |
| ***E21B 17/20*** | (2006.01) |
| ***E21B 47/00*** | (2012.01) |
| ***E21B 47/12*** | (2012.01) |
| ***E21B 4/00*** | (2006.01) |
| ***E21B 7/04*** | (2006.01) |

(52) U.S. Cl.
CPC ..... *E21B 17/028* (2013.01); *E21B 17/03* (2013.01); *E21B 17/20* (2013.01); *E21B 47/00* (2013.01); *E21B 47/12* (2013.01)

(58) Field of Classification Search
CPC ... E21B 47/02; E21B 4/00; E21B 7/04; E21B 47/12
See application file for complete search history.

(56) References Cited

U.S. PATENT DOCUMENTS

| | | | | |
|---|---|---|---|---|
| 6,057,784 | A * | 5/2000 | Schaaf | E21B 47/12 340/854.4 |
| 9,657,520 | B2 * | 5/2017 | Altimas | E21B 4/02 |
| 2018/0224573 | A1 * | 8/2018 | Yang | E21B 47/026 |

FOREIGN PATENT DOCUMENTS

| | | | |
|---|---|---|---|
| CN | 203702140 | U | 7/2014 |
| CN | 205100962 | U | 3/2016 |
| CN | 105464646 | A | 4/2016 |
| RU | 2200835 | C2 | 3/2003 |

* cited by examiner

NEAR-BIT MEASUREMENT WHILE DRILLING SYSTEM

TECHNICAL FIELD

The present invention relates to the drilling technology field.

BACKGROUND ART

In the field of petroleum drilling and exploitation, the directional drilling technology is significantly important to improve recovery ratio of crude oil and stabilize oil field output. Especially for complex hydrocarbon reservoir, the drilling-encounter ratio and well trajectory control has always been the main factors to restrict cost reduction of drilling and exploitation while the accurate information and data on the formation where the drill bit is located plays a decisive role to realize the favorable drilling-encounter effect. Thus, the technology on geological steering of drilling becomes the indispensable key technology for the directional well development. The technology on geological steering of drilling for directional well confirms and controls the well trajectory based on the actual geological features, and then controls accurately downhole motor to hit the target formation. The key technology for allowing the drill to encounter the optimal target formation, also named effective reservoir, is to control well trajectory, ensure the drill bit to penetrate in the effective reservoir and avoid the encountering on interlayer to the greatest extend.

The measurement while drilling instrument with conventional method for measurement while drilling is set upon the motor, and the measurement position is normally located beyond 10 meters from the lower surface of motor system. During drilling, because of the long distance between drill bit and measurement instrument, the data and information for the formation where the drill bit is located cannot be accurately measured in real time, frequently causing that the drill bit penetrates out of hydrocarbon reservoir, particularly the thin hydrocarbon reservoir.

The application of conventional near-bit measurement while drilling is able to conquer the defect that the data and information for the formation where the drill bit is located fail to be measured accurately in real time. The short sub of near-bit measurement while drilling system is set at the lower position of motor system and is connected with drill bit directly so that the measurement location is near the drill bit. However, due to the adding of short sub for the measurement while drilling between drill bit and motor system, the distance between drill bit and bent point of motor is increased, which will cause the lowering of controllability on drill bit and the increasing of friction and torque for the downhole motor at the bottom hole as well as the raising of vibration of drill bit during operation. Because the short sub for measurement while drilling is added for the conventional near-bit measurement while drilling, the structure of the bottom hole drilling tool combination has been changed and then causes the change of mechanical characteristics, which lead to the decreasing of deflecting capability of downhole motor. Thus the controllability on well trajectory is insufficient and the frequent hysteresis on control of well trajectory causes long time for hole straightening. The impact caused from vibration of drill bit in the process of operation aggravates the damage of bottom hole tools. Moreover, when the data and information from conventional near-bit measurement while drilling method are transmitted to receiving device through wireless mode, the wireless transmitting signals must penetrate the obstacle of downhole motor system, thus leads to long transmitting distance and signal transmission without stability and reliability.

The objective of the invention is to: focusing on the existing problems mentioned above of fields on drilling and exploration, provide a near-bit measurement while drilling system which is able to measure the data and information of formation where the drill bit is near and which can acquire the data and information of the formation where the drill bit is located and well trajectory parameters more accurately in real time for the realization of improving drilling-encounter ratio of drill bit, maintaining high guiding and control capability on drilling tools, enhancing well trajectory controllability, improving recovery ratio and reducing drilling cost.

The Objective of the Invention Shall be Realized Through the Following Technical Solution:

A near-bit measurement while drilling system contains motor system, measurement transmission system, wireless receiving system and non-magnetic short sub. The motor system is composed of the external housing and the internal rotation part, and the non-magnetic short sub is set upon the motor system. Meanwhile, the non-magnetic short sub and the motor system are connected directly or through drilling tools or via short sub. A hole is set inside the internal rotation part of the motor system. The measurement transmission system contains a measurement device of data acquisition and data measurement, a transmitting device of the wireless receiving system to which the data of the measurement device is transmitted, a transmission device of transmitting device to which the data of measurement device is transmitted, and a power supply device for supplying electric energy to the measurement device and the transmitting device. The measurement device and the transmission device of the measurement transmission system are set inside the hole of the internal rotation part of the motor system. The measurement device is set within ⅓ lower position of the motor system and within 2 meters from the bottom surface of the motor system. The transmitting device of the measurement transmission system is set at the upper position of the internal rotation part of the motor system and extends into the non-magnetic cavity. The measurement transmission system is relatively fixed with the rotation part of the motor system and is able to rotate along with the external housing of motor system together with the internal rotation part of the motor system. The wireless receiving device of the wireless receiving system is set inside and relatively fixed with the non-magnetic short sub. When the motor system is in operation, the measurement transmission system makes relative rotation upon the wireless receiving system, and the wireless receiving device and the transmitting device will transmit signals through wireless transmission.

Preferably, the measurement device is set within 1.5 meters from the bottom surface of the motor system. Further preferably, the measurement device is set within 1 meter from the bottom surface of the motor system.

Preferably, the motor system belongs to downhole motor system, a excellent motor tool in the aspect of oriented drilling, which is able to provide large torque and high rotation speed and which is capable of admirable performance on oriented drilling. Meanwhile, with the compact structure, the downhole motor system is applicable in drilling at directional well and clusters well. The combination of downhole motor system and the measurement while drilling system is capable of making deflection, orientation and deviation correction, which will improve project quality and reduce drilling cost.

Further preferably, the rotation part of the downhole motor system includes at least a drive shaft, a universal shaft and a rotor. The measurement device is set inside the drive shaft of the downhole motor system, which is relatively fixed with the drive shaft and is able to rotate together with the drive shaft. Through the direct connection of the drive shaft from the downhole motor system and the drill bit, the measurement device is very close to the drill bit so that the data and information where the drill bit is located can be accurately measured in real time. Because the measurement device is set in the inner part of the drive shaft, there is no increasing of distance between the drill bit and the motor bend point so as to enhance the guiding controllability of drill bit, reduce the friction and torque in bottom hole compared with those where the short sub is added between the drill bit and the motor, and decrease the vibration of drill bit during operation. Furthermore, the drilling tools will keep high capability of deflection and hole straightening, ensure the quality of well trajectory, reduce drilling cost, raise recovery ratio, decrease transmission resistance, improve drilling efficiency, bring down the vibration impact of drill bit at bottom hole and thus reduce the damage caused by the vibration impact on the downhole tool such as the drill bit.

Further preferably, the transmitting device is set at the upper position of the rotor. The transmitting device is relatively fixed with the rotor and is able to rotate together with the rotor. The transmitting device is set at the upper position of the rotor so that the transmitting device is close to the receiving device of the wireless receiving system. And no obstacle exists between the transmitting device and the receiving device as for signal transmission. Meanwhile, the entire measurement while drilling system is able to rotate together with drill bit in order to effectively protect the measurement transmission system.

Preferably, the power supply device of the measurement transmission system is set inside the hole of the internal rotation part of the motor system, which is located between the measurement device and the transmitting device and more close to the transmitting device. The power supply device provides reliable power supply for the measurement transmission system to ensure the continuous and stable operation of the measurement transmission system.

Preferably, the measurement device contains an azimuth gamma sensor and a well deviation sensor. The azimuth gamma sensor is used for acquisition of azimuth gamma data and the well deviation sensor is used for measurement of well deviation data. In the process of directional drilling, the data of azimuth gamma and well deviation of the formation where the drill bit is located is the primary and most important basic data, which directly determines the quality of well trajectory and drilling-encounter ratio, and which affects the recovery ratio and drilling cost.

Preferably, the safety anti-drop assembly is set between the motor system and the non-magnetic sub. The safety anti-drop assembly contains safety an anti-drop sub and a safety anti-drop cap. A through-hole in the center of the safety anti-drop cap with axial penetration is set at and fixed with the upper position of the internal rotation part of the motor system. The transmitting device of the measurement transmission system penetrates the through-hole in the center of the safety anti-drop cap and extends into the non-magnetic safety anti-drop cavity. The lower position of the safety anti-drop sub is connected with the external housing of the motor system, and the upper position is connected with the non-magnetic short sub. Meanwhile, the limit shoulder is set at the inner wall of the lower position of the safety anti-drop sub. The flange is set at the outer wall of the upper position of the safety anti-drop cap and is used to catch the inner part of the motor system at the limit shoulder in case of the fracture of lower part of housing. The safety anti-drop assembly is able to prevent the motor system from dropping into bottom hole in case of housing fraction so as to reduce the salvage cost and drilling risk and thus to improve the safety and reliability of the patent. Preferably, the non-magnetic short sub is a non-magnetic collar. When the non-magnetic short sub is directly connected with the motor system, the transmitting device of the measurement transmission system will extend into the cavity of the non-magnetic collar. The signals are transmitted wirelessly between the transmitting device and the receiving device in the patent, and the magnetically short connection will interfere and influence the stable and reliable transmission of wireless signals. Meanwhile, as one part of the drilling pipe, the non-magnetic collar also performs the stabilization effect without impacting on the transmission of wireless signals.

The main scheme and various further preferable selection schemes in the invention are able to form multiple schemes through independent assortment, which shall be applied and required to protect in the invention. Meanwhile, the selection schemes themselves without selection conflict from each other are also able to be combined freely. The technicians in this field are able to clearly identify multiple combinations after understanding the invention scheme based on the existing technology and common general knowledge. Those technical solutions shall all be protected in the invention, and will not be listed in exhaustion.

The beneficial effect in the invention: For the near-bit measurement while drilling system in the invention, the measurement device is set near the drill bit inside the motor system so as to measure the real-time data and information as well as the well trajectory parameters for the formation where the drill bit is located more accurately during drilling on the one hand, and is capable of transmitting the measured data and information wirelessly in real time stably and reliably to the receiving device of the wireless receiving system. The measurement while drilling system is set inside the motor system and will keep the drilling tool with capability of high deflection and hole straightening.

Compared with the conventional method for measurement while drilling, the measurement position in the invention is within 2 meters (even short such as within 1.5 meters and within 1 meter) from the lower surface of the motor system and is close to the drill bit. Hence, the data and information for the formation where the drill bit is located is able to be measured more accurately in real time in the process of drilling so as to effectively avoid the drill bit penetrating the hydrocarbon reservoirs, especially the thin ones, which improves the drilling-encounter ratio of the oil layer and performs the non-hysteretic description of well trajectory significantly.

Compared with conventional method for near-bit measurement while drilling, the measurement device in the invention is set between the drill bit and the bend point of deflection without any influence on the distance between the drill bit and the bend point (There is no need to add any short sub or tool between the drill bit and the motor, thus the distance from the drill bit to the motor or bend point does not increase) so as to enhance the guiding controllability of drill bit, reduce the friction and torque in bottom hole compared with those where the short sub is added between drill bit and motor, and decrease the vibration of drill bit during operation. Furthermore, the drilling tools will keep high capability of deflection and hole straightening, ensure the quality of well trajectory, reduce drilling cost, raise recovery ratio, decrease transmission resistance, improve drilling efficiency, bring down the vibration impact of drill bit at bottom hole and thus reduce the damage caused by the vibration impact on the downhole tool such as the drill bit. On the other hand, compared that the data and information is transmitted to the receiving device of the receiving system wirelessly as for the conventional method of near-bit measurement while drilling, the wireless signals in the invention will be directly transmitted to the transmitting device near the receiving device of the wireless receiving system through the transmission device of the measurement transmission system (wire transmission) and then transmitted to the receiving device wirelessly without penetrating through the downhole motor system, which largely shortens the transmission channel for the wireless data transmission with no obstacles and enhances the stability and reliability of the signal transmission.

The near-bit measurement while drilling system in the invention is characteristic of compact structure and the measurement transmission system is set inside the motor system, which solves the problem on the acquisition of the data and information for the formation where the drill bit is located and well trajectory parameters more accurately in real time for the realization of improving drilling-encounter ratio of drill bit, maintaining high guiding and control capability on drilling tools, enhancing well trajectory controllability, improving recovery ratio and reducing drilling cost. Meanwhile, the wireless communication transmission in short distance without obstacles can be realized between the transmitting device of the measurement transmission system and the receiving device of the receiving system so as to fulfill the short-distance test and transmission, thus improving the stability and reliability of data transmission. The measurement device is very close to the drill bit in the invention. The more the measurement device is close to the drill bit, the more accurately the real-time data and information as well as parameters of well trajectory for the formation where the drill bit is located are measured in the process of drilling, and the higher drilling-encounter ratio and recovery ratio of the drill bit is.

BREIF DESCRIPTION OF THE DRAWINGS

Figure 2:
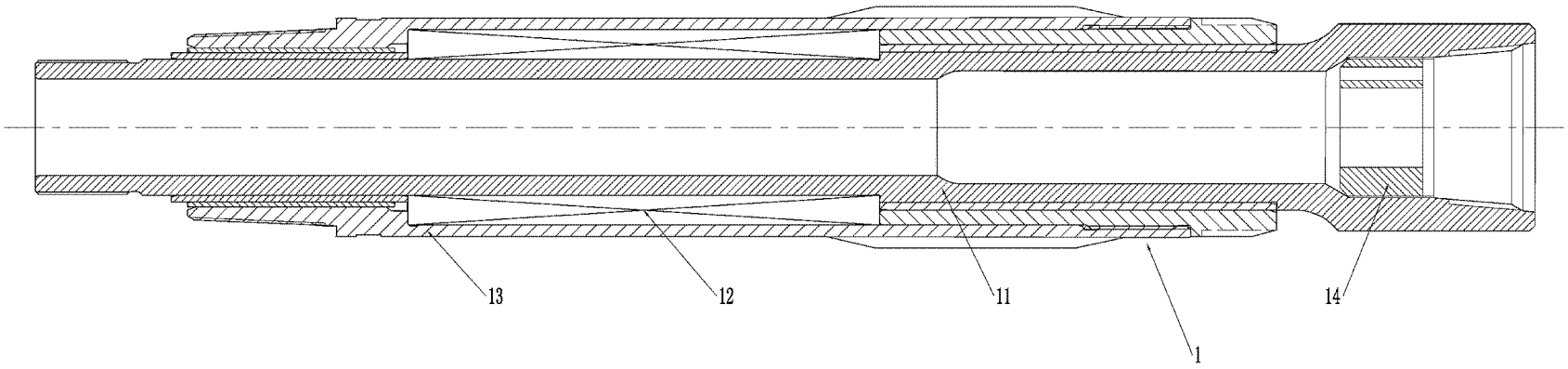

FIG. 1 Structural Diagram for the Embodiment 1 in the Invention;

FIG. 2 Schematic Diagram of the Drive shaft Assembly in Near-bit Measurement While Drilling System for the Embodiment 3.

Figure 3:
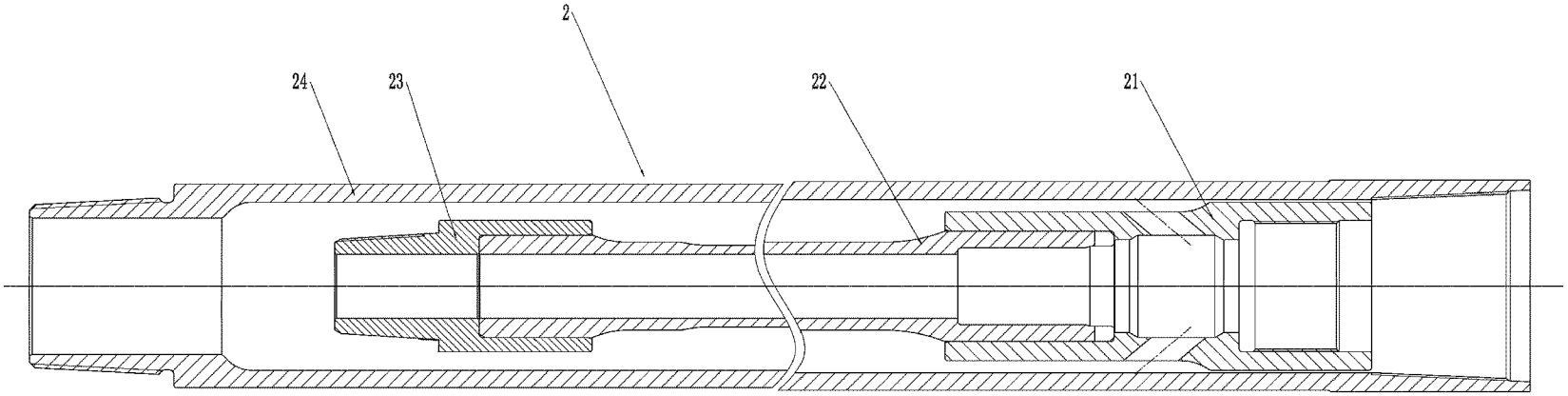

FIG. 3 Schematic Diagram of the Universal Shaft Assembly in Near-bit Measurement While Drilling System for the Embodiment 4.

Figure 4:
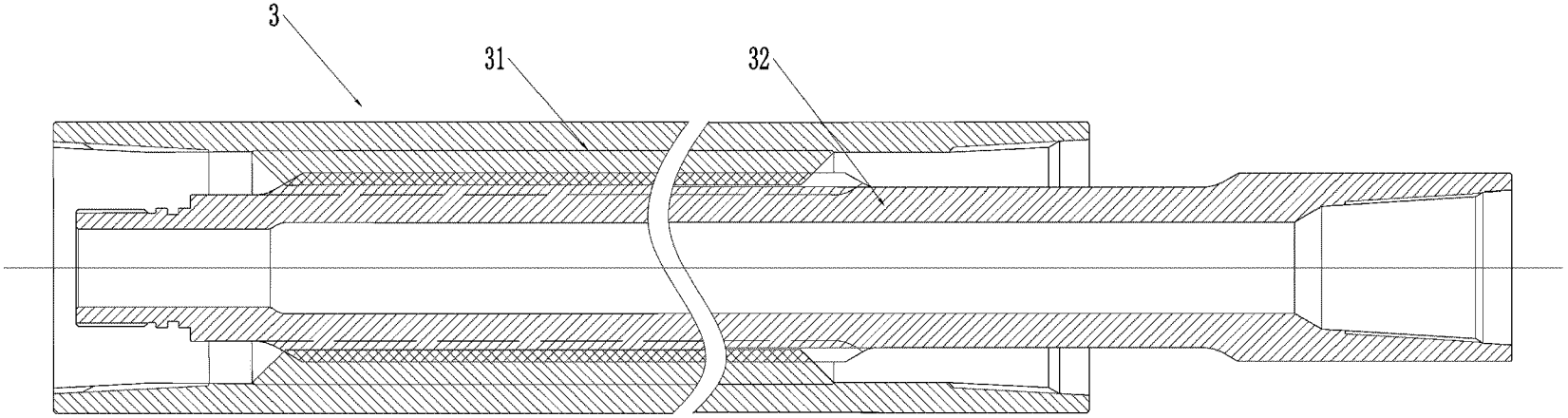

FIG. 4 Schematic Diagram of the Motor Assembly in Near-bit Measurement While Drilling System for the Embodiment 5.

Figure 5:
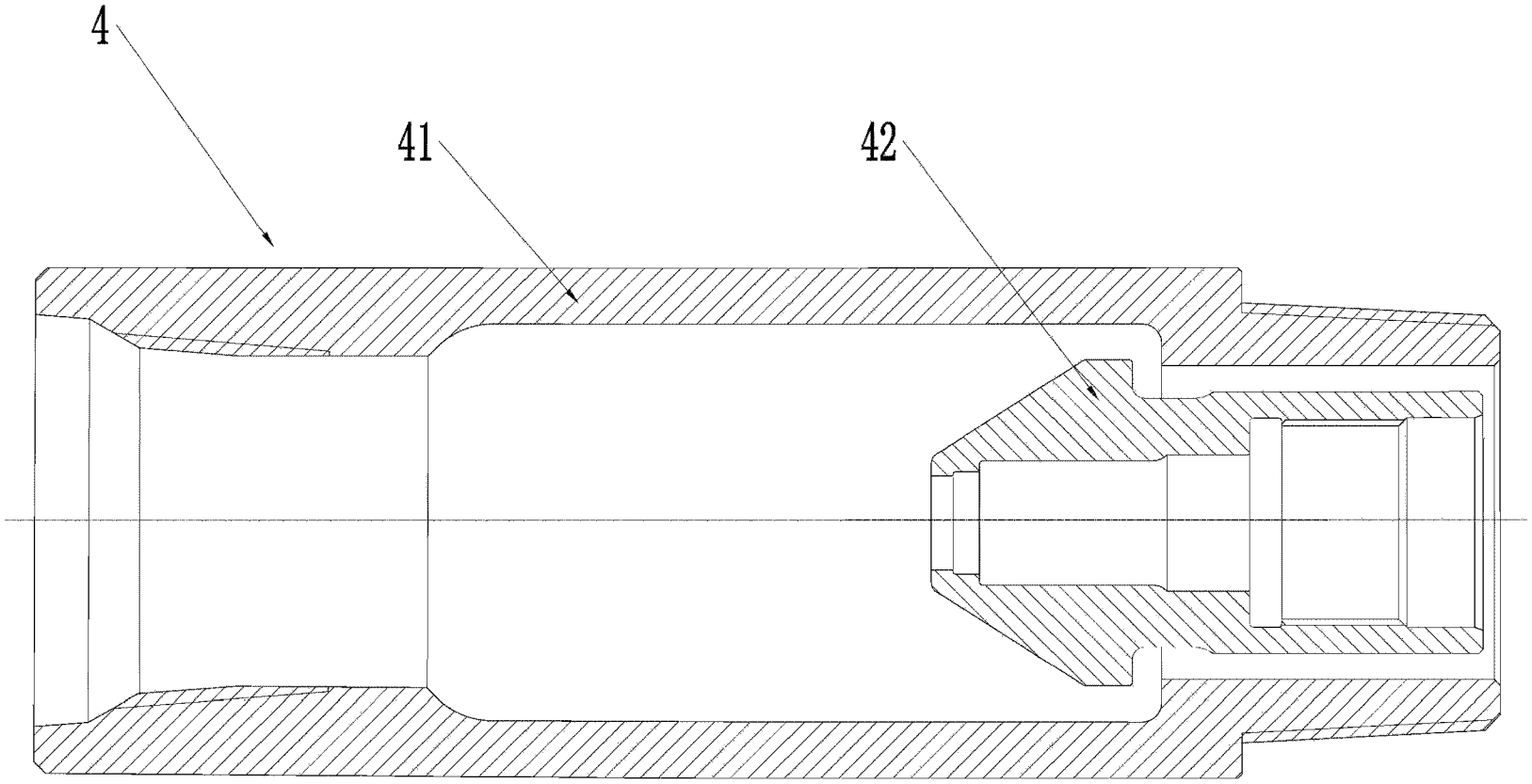

FIG. 5 Schematic Diagram of the Safety Anti-drop Assembly in Near-bit Measurement While Drilling System for the Embodiment 6.

EMBODIMENTS

The following non-restrictive embodiments will illustrate the invention.

Embodiment 1:

FIG. 1 shows a near-bit measurement while drilling system 10 including the motor system 20, the measurement transmission system 6, the wireless receiving system 5 and the non-magnetic short sub 7. The motor system 20 comprises the external housing and the internal rotation part. The non-magnetic short sub 7 is set upon the motor system 20. Meanwhile, the non-magnetic short sub 7 and the motor system 20 are connected directly or through the drilling tool or via the short sub. A hole is set inside the internal rotation part of the motor system 20. The measurement transmission system 6 contains the measurement device 61 of data acquisition and data measurement, the transmitting device 64 of the wireless receiving system 5 to which the data of the measurement device 61 is transmitted, the transmission device 62 of the transmitting device 64 to which the data of the measurement device 61 is transmitted, and the power supply device 63 for supplying electric energy to the measurement device 61 and the transmitting device 64. The measurement device 61 and the transmission device 62 of the measurement transmission system 6 are set inside the hole of the internal rotation part of the motor system 20. The measurement device 61 is set within ⅓ lower position of the motor system 20 and within 2 meters from the bottom surface of the motor system 20. The transmitting device 64 of the measurement transmission system 6 is set at the upper position of the internal rotation part of the motor system 20 and extends into non-magnetic cavity. The measurement transmission system 6 is relatively fixed with the rotation part of the motor system 20 and is able to rotate along with the external housing of motor system 20 together with the internal rotation part of the motor system 20. The wireless receiving device 51 of the wireless receiving system 5 is set inside and relatively fixed with the non-magnetic short sub 7. When the motor system 20 is in operation, the measurement transmission system 6 makes relative rotation upon the wireless receiving system 5, and the wireless receiving device 51 from the wireless receiving system 5 and the transmitting device 64 from the measurement transmission system 6 will transmit signals through wireless transmission.

Preferably, the measurement device 61 is set within 1.5 meters from the bottom surface of the motor system 20. Further preferably, the measurement device 61 is set within 1 meter from the bottom surface of the motor system 20.

Preferably, the motor system 20 belongs to downhole motor system. Preferably, the rotation part of the downhole motor system includes at least the drive shaft 11, the universal shaft 22 and the rotor 32. The measurement device 61 is set inside the drive shaft 11 of the downhole motor system, which is relatively fixed with the drive shaft 11 and is able to rotate together with the drive shaft 11.

Preferably, the transmitting device 64 is set at the upper position of the rotor 32. The transmitting device 64 is relatively fixed with the rotor 32 and is able to rotate together with the rotor 32.

Preferably, the power supply device 63 of the measurement transmission system 6 is set inside the hole of the internal rotation part of the motor system 20, which is located between the measurement device 61 and the transmitting device 64 and more close to the transmitting device 64, and which supplies electric energy for the measurement device 61 and the transmitting device 64.

Preferably, the measurement device 61 contains an azimuth gamma sensor and a well deviation sensor. The azimuth gamma sensor is used for acquisition of azimuth gamma data and the well deviation sensor is used for measurement of well deviation data.

Preferably, the non-magnetic short sub 7 is a non-magnetic collar. When the non-magnetic short sub 7 is directly connected with the motor system 20, the transmitting device 64 of the measurement transmission system 6 will extend into the cavity of the non-magnetic collar.

Embodiment 2:

A near-bit measurement while drilling system 10 is basically similar with Embodiment 1. The difference is: including the motor system 20, the measurement transmission system 6, the wireless receiving system 5 and the non-magnetic short sub 7. The non-magnetic short sub 7 is the non-magnetic collar, and the motor system 20 is the downhole motor system, which is composed of the drive shaft assembly 1, the universal shaft assembly 2, motor assembly 3 and safety anti-drop assembly 4. The four components mentioned respectively consist of the external housing and the internal rotation part, the external housings of which constitute the external housing of the motor system 20 through sequential threaded connection and the internal rotation parts of which constitute the internal rotation part of the motor system 20 through sequential threaded connection. A through-hole designed inside of the internal rotation part not only delivers the force on rock breaking for the drill bit, but also is used as a carrier for the measurement transmission system 6. The non-magnetic collar is connected on the upper position of the external housing of the motor system 20 through thread.

Embodiment 3:

The embodiment is basically similar with Embodiment 1 and Embodiment 2. The difference is: FIG. 2 shows the drive shaft assembly 1 from the downhole motor system (the motor system 20) in the near-bit measurement while drilling system 10, including the drive shaft 11, the bearing group 12, the drive shaft housing 13 and the support ring 14. The upper position of the drive shaft 11 is threaded connection with the universal shaft 2 and the lower position with the drill bit. The shaft neck is encased with the bearing group 12 (radial bearing group and thrust bearing group), the main effect of which is to deliver bit weight, rotation speed and torque for the drill bit, and the through-hole sets the measurement device 61 (short sub for measurement of well deviation and azimuth gamma).

Embodiment 4:

The embodiment 4 is basically similar with Embodiment 1-3. The difference is: FIG. 3 shows the universal shaft assembly 2 from the downhole motor system (the motor system 20) in the near-bit measurement while drilling system 10, including the diversion joint 21, the flexible shaft 22, the rotor sub 23 and the universal shaft housing 24. The diversion joint 21 is located inside the universal shaft housing 24, the lower end of which is connected to the drive shaft 11 through thread, performing the transmission of torque and rotation speed to the drive shaft 11. The mud channel is set at the side wall of the diversion joint 21 penetrating through its own inner hole so as to divert the mud into the inner hole of the drive shaft 11. The upper end and lower end of the flexible shaft are inserted in the lower end of the rotor sub 23 and the upper end of the diversion joint 21 respectively through rivet connection. The through-holes exist separately in the diversion joint 21, the flexible shaft 22 and rotor sub 23 and penetrate to form a channel for the measurement transmission system 6. The lower end of the universal shaft housing 24 is threaded connection with the drive shaft housing 13 and the upper end with the stator 31, together forming a part of the 5 external housing of the motor system 20. The main functions of the universal shaft assembly 2 are to convert the eccentric motion of the rotor 32 to the coaxial movement and transmit torque and rotation speed downwards on the one hand, and to provide channel and protection for the transmission device 62 of the measurement transmission system 6.

Embodiment 5:

The embodiment 5 is basically similar with Embodiment 1-4. The difference is: FIG. 4 shows the motor assembly 3 from the downhole motor system (the motor system 20) in the near-bit measurement while drilling system 10, including the stator 31 and the rotor 32. The lower end of the stator 31 is threaded connection with the upper end of the universal shaft housing 24 and the upper end with the safety anti-drop sub 41 of the safety anti-drop assembly 4, in which the stator 31 becomes a part of the external housing of the motor system. The rubber sleeve with the characteristic of space geometry is inside the inner wall of the stator 31. The stator 31 and the rotor 32 constitute the motor assembly 3. The motor 32 is characteristic of spiral surface with certain space geometry and forms the conjugate pair together with the rubber sleeve of the stator 31. Under the driving of the drilling fluid, the rotor 32 makes planetary motion inside the stator 31 to create rotation speed and torque. The lower end of the rotor 32 is threaded connection with the rotor sub 23 of the universal assembly 2, which allows the rotor 32 to transmit rotation speed and torque for the flexible shaft 22 through the rotor sub 23. The outer thread of upper end from the rotor 32 is threaded connection with the safety anti-drop cap 42 of the anti-drop assembly 4. The inner thread of the upper end from the rotor 32 is connected with the transmitting device 64 of the measurement transmission system 6.The rotor 32 is characteristic of hollow structure where the transmission device 62 and the power supply device 63 are placed.

Embodiment 6:

The embodiment 6 is basically similar with Embodiment 1-5. The difference is: FIG. 5 shows the safety anti-drop assembly 4 from the downhole motor system (the motor system 20) in the near-bit measurement while drilling system 10, including the safety anti-drop sub 41 and the safety anti-drop cap 42. The lower end of the safety anti-drop sub is threaded connection with the stator 31 of the motor and the upper end with the non-magnetic collar 7, which becomes a part of the external housing of the motor system 20. The inner cavity of the safety anti-drop sub 41 contains the transmitting device 64 of the measurement transmission system 6, the material and function of which are same with the non-magnetic collar 7. The through-hole exists at the center of the safety anti-drop cap 42 with axial penetration and the lower end is threaded connection with the rotor 32, which composes the inner rotation part of the motor system 20. The flange is set at the outer wall of the upper end of the safety anti-drop cap 42 and the limit shoulder is set at the inner wall of the lower end of the safety anti-drop sub 41. The outer diameter of the flange of safety anti-drop cap 42 is larger than the inner diameter of the limit shoulder of safety anti-drop sub 41. In case of the fracture of lower part of housing, the flange will be jammed at the limit shoulder to prevent axial displacement for future pulling out the lower part of the drilling tool.

Embodiment 7

The embodiment 7 is basically similar with Embodiment 1-6. The difference is: FIG. 1 shows the measurement transmission system 6 from the near-bit measurement while drilling system 10, including the measurement device 61, the transmission device 62, the power supply device 63 and the transmitting device 64. The measurement device 61 is the short sub for the measurement of well deviation/azimuth gamma, which is set inside the drive shaft 11 from the downhole motor system (the motor system 20) within 1 meter from the lower bottom surface of the downhole motor system. The measurement device 61 (short sub for the measurement of well deviation/azimuth gamma) contains an azimuth gamma sensor, an azimuth gamma circuit module, a well deviation sensor, a well deviation circuit module and a sensing tube. The sensing tube is set on and fixed with the support ring 14 of the drive shaft 11. The lower part of the sensing tube is the solid hole, and the upper end is threaded connection with the transmission device 62 in order to protect the sensors and the circuit modules on the one hand and to function as the power supply interface for the measurement device 61 (short sub for the measurement of well deviation/azimuth gamma). The azimuth gamma sensor, the azimuth gamma circuit module, the well deviation sensor and the well deviation circuit module are set sequentially in the sensing tube. The azimuth sensor is used to measure the natural gamma of formation and the acquired data will be transmitted to the azimuth gamma circuit module for processing. The azimuth gamma circuit module is composed of various electronic elements and circuit board and performs the processing for the gamma data of formation acquired from the azimuth gamma sensor. The well deviation sensor and the well deviation circuit module are used to measure and calculate the well deviation data. The well deviation data measured by the well deviation sensor include the deviation angle and azimuth angle.

The transmitting device 64 of the measurement transmission system 6 is set at the upper position of the rotor 32 from the downhole motor system and extends into the inner cavity of the safety anti-drop sub 41 from the safety anti-drop assembly 4 through the through-hole in the center of the safety anti-drop cap 42. The lower end is threaded connection with the power supply 63, which is used for transmitting the data of the well deviation and azimuth gamma measured from the near drill bit wirelessly upwards to the receiving device 51 of the wireless receiving system 5.

The lower end of the transmission device 62 of the measurement transmission system 6 is threaded connected with the sensing tube and the upper end with the power supply device 63, providing channel for the transmission of measured data and information and the power transmission for the measurement transmission system 6. The measurement transmission system 6 is located in the through-hole of the internal rotation part from the drive shaft assembly 1, the universal shaft assembly 2 and the motor assembly 3, which is relatively fixed with the rotation part of the motor system 20 and which rotates along with the external housing of the motor system 20 together with the rotation part.

The lower end of the power supply device 63 of the measurement transmission device 6 is threaded connection with the transmission device 62 and the upper end with the transmitting device 64. The power supply device 63 is relatively close to the transmitting device 64 and provides electric energy for the measurement device 61 and the transmitting device 64.

Embodiment 8:

The embodiment 8 is basically similar with Embodiment 1-7. The difference is: FIG. 1 shows the non-magnetic short sub 7 (non-magnetic collar) from the near-bit measurement while drilling system 10 is set between the safety anti-drop assembly 4 and the drill pipe. The lower part is threaded connection with the safety anti-drop short sub 41 of the safety anti-drop assembly 4 and the upper part with the drill pipe. The transmitting device 64 of the measurement transmission system 6 and the receiving device 51 of the wireless receiving system 5 are both set inside the non-magnetic collar 7. However, the non-magnetic material may not be applied in the safety anti-drop sub 41 of the safety anti-drop assembly 4.

Embodiment 9:

The embodiment 9 is basically similar with Embodiment 1-8. The difference is: the non-magnetic short sub 7 (non-magnetic collar) of the near-bit measurement while drilling system 10 is set between the motor system 20 and the drill pipe. The lower part is threaded connection with the stator 31 of the motor assembly 3 and the upper part with the drill pipe. The transmitting device 64 of the measurement transmission system 6 and the receiving device 51 of the wireless receiving system 5 are both set inside the non-magnetic collar 7.

Embodiment 10:

The embodiment 10 is basically similar with Embodiment 1-9. The difference is: the wireless receiving device 51 of the wireless receiving system 5 from the near-bit measurement while drilling system is set inside the non-magnetic collar 7 which is connected with the upper part of the safety anti-drop assembly 4. The wireless receiving device 51 is relatively fixed with the non-magnetic collar 7. When the motor system 20 is in operation, the measurement transmission system 6 rotates relatively with the wireless receiving device 51. The wireless receiving device 51 of the wireless receiving system 5 and the transmitting device 61 of the measurement transmission system 6 transmit the signal through the way of wireless transmission. The wireless receiving device 51 will receive and transmit the measured data and information to the ground.

The embodiments above mentioned are preferably selected in the invention, which shall not limit the invention. Any modification, equivalent replacement and improvement within the spirit and principle of the invention shall be contained in the scope of protection for the invention.

The invention claimed is:

1. A near-bit measurement while drilling system, comprising: a motor system, a measurement transmission system, a wireless receiving system, a safety anti-drop assembly, and a non-magnetic short sub, wherein the motor system comprises an external housing and an internal rotation part disposed inside the housing, wherein the measurement transmission system comprises a measurement device for data acquisition and data measurement, a transmitting device for transmitting the data from the measurement device to the wireless receiving system, and a power supply device for supplying electric energy to the measurement device and the transmitting device, wherein the measurement device and the transmission device are disposed inside a cavity in the internal rotation part of the motor system, wherein the measurement device is disposed within ⅓ lower downhole portion of the motor system and within 2 meters from a bottom downhole surface of the motor system, wherein the transmitting device is disposed at an upper uphole portion of the internal rotation part and extends into a cavity in the non-magnetic short sub, the measurement transmission system is fixed relative to the internal rotation part and is configured to rotate along with the external housing together with the internal rotation part, wherein a wireless receiving device is disposed inside and fixed relative to the non-magnetic short sub, wherein, during operation, the measurement transmission system rotates relative to the wireless receiving system, wherein the safety anti-drop assembly is disposed between the motor system and the non-magnetic short sub, and wherein the safety anti-drop assembly comprises a safety anti-drop sub and a safety anti-drop cap, wherein a through-hole extends through the safety anti-drop cap in an axial direction and the upper uphole portion of the internal rotation part, wherein the transmitting device extends through the through-hole in the safety anti-drop cap and extends into a cavity in the safety anti-drop cap, wherein a lower downhole portion of the safety anti-drop sub is connected with the external housing of the motor system, and an upper uphole portion of the safety anti-drop assembly is connected with the non-magnetic short sub, wherein a limit shoulder is set at an inner wall of the lower downhole portion of the safety anti-drop sub; and wherein a flange is set at an outer wall of the upper uphole portion of the safety anti-drop cap and is configured to catch the inner rotation part at the limit shoulder.

2. The near-bit measurement while drilling system according to claim 1, wherein the measurement device is disposed within 1.5 meters from the bottom downhole surface of the motor system.

3. The near-bit measurement while drilling system according to claim 2, wherein the measurement device is disposed within 1 meter from the bottom downhole surface of the motor system.

4. The near-bit measurement while drilling system according to claim 3, wherein the motor system is a downhole motor system.

5. The near-bit measurement while drilling system according to claim 2, wherein the motor system is a downhole motor system.

6. The near-bit measurement while drilling system according to claim 1, wherein the motor system is a downhole motor system.

7. The near-bit measurement while drilling system according to claim 6, wherein the rotation part of the downhole motor system comprises a drive shaft, a flexible shaft, and a rotor; and wherein the measurement device is disposed inside the drive shaft of the downhole motor system, and is fixed relative to the drive shaft and configured to rotate together with the drive shaft.

8. The near-bit measurement while drilling system according to claim 7, wherein the transmitting device is disposed at the upper uphole portion of the rotor and is fixed relative to the rotor and is configured to rotate together with the rotor.

9. The near-bit measurement while drilling system according to claim 1, wherein the power supply device of the measurement transmission system is disposed inside the hole in the internal rotation part of the motor system, and is located between the measurement device and the transmitting device.

10. The near-bit measurement while drilling system according to claim 1, wherein the measurement device comprises an azimuth gamma sensor and a well deviation sensor.

11. The near-bit measurement while drilling system according to claim 1, wherein the non-magnetic short sub is a non-magnetic collar, and when the non-magnetic short sub is directly connected with the motor system, the transmitting device of the measurement transmission system extends into the cavity in the non-magnetic collar.

* * * * *